US012024905B2

(12) United States Patent
Godwin

(10) Patent No.: US 12,024,905 B2
(45) Date of Patent: Jul. 2, 2024

(54) CONCRETE FORM CONSTRUCTION APPARATUS AND SYSTEM

(71) Applicant: Chad Godwin, Oklahoma City, OK (US)

(72) Inventor: Chad Godwin, Oklahoma City, OK (US)

(73) Assignee: Godwin Formwork Solutions, LLC, Oklahoma City, OK (US)

( * ) Notice: Subject to any disclaimer, the term of this patent is extended or adjusted under 35 U.S.C. 154(b) by 2 days.

(21) Appl. No.: 17/169,043

(22) Filed: Feb. 5, 2021

(65) Prior Publication Data

US 2022/0290450 A1 Sep. 15, 2022

Related U.S. Application Data

(63) Continuation-in-part of application No. 15/906,597, filed on Feb. 27, 2018, now abandoned.

(51) Int. Cl.
*E04G 17/075* (2006.01)

(52) U.S. Cl.
CPC ..... *E04G 17/0757* (2013.01)

(58) Field of Classification Search
CPC . E04G 17/06; E04G 17/0752; E04G 17/0751; E04G 17/075; E04G 17/04; E04G 17/0754; E04G 17/0757; E04G 17/075; E04G 17/047; E04G 17/02; E04G 17/0721
USPC ..... 249/40, 213, 216, 46
See application file for complete search history.

(56) References Cited

U.S. PATENT DOCUMENTS 1,629,899 A 5/1927 Wustholz
1,687,977 A 10/1928 Ford
1,925,689 A * 9/1933 Dietrich ..... F16B 37/0878 249/213
1,940,278 A * 12/1933 Walker ..... E04G 17/075 254/104
2,133,574 A * 10/1938 Allen ..... E04G 17/0752 249/213
2,358,975 A * 9/1944 Hillberg ..... E04G 17/0721 249/46
2,433,934 A * 1/1948 Symons ..... E04G 17/0721 249/190
2,528,031 A 10/1950 Burson
2,670,773 A 3/1954 Avery
(Continued)

*Primary Examiner* — Brian E Glessner
*Assistant Examiner* — Daniel J Kenny
(74) *Attorney, Agent, or Firm* — Edward L. White, PC; Edward L. White

(57) ABSTRACT

A concrete form apparatus and system for connecting opposing form sections at a desired distance from each other defining a space to receive poured concrete, the apparatus preventing the form section separation, the apparatus including a locking pin, form connector rotatably and releasably affixed to a form, and retainer affixed to arm defining a channel therein sized to be engaged within the slot whereby the locking pin is placed through corresponding holes in adjacent forms and engages a first form, extends through the relative distance between the forms, exits through a hole in the second form, and the channel of the retainer attached to the second form engages the locking slot on the locking pin maintaining a fixed distance between the forms and preventing form separation when pouring concrete. A system using the foregoing and also including clamps for affixing adjoining forms to one another is also claimed.

6 Claims, 12 Drawing Sheets

(56) References Cited

U.S. PATENT DOCUMENTS

| | | | | | |
|---|---|---|---|---|---|
| 2,674,284 | A | | 4/1954 | Sitton | |
| 2,920,371 | A | * | 1/1960 | Shoemaker | E04G 17/0721 249/214 |
| 2,946,360 | A | | 7/1960 | Solo | |
| 3,363,877 | A | * | 1/1968 | Harris | E04G 17/06 249/190 |
| 3,529,800 | A | * | 9/1970 | Harris | E04G 17/0721 249/219.2 |
| 3,693,931 | A | * | 9/1972 | Holt | E04G 17/0721 249/219.2 |
| 3,767,158 | A | * | 10/1973 | Mikus | E04G 17/001 249/192 |
| 3,888,455 | A | * | 6/1975 | Mikus | E04G 17/047 249/214 |
| 3,977,647 | A | * | 8/1976 | Williams | E04G 17/0742 249/191 |
| 3,984,079 | A | * | 10/1976 | Gates | E04G 17/0742 249/42 |
| 4,044,986 | A | * | 8/1977 | Strickland | E04G 17/0657 249/216 |
| 4,254,932 | A | * | 3/1981 | Durbin | E04G 11/12 249/18 |
| 4,545,163 | A | * | 10/1985 | Asselin | E04G 17/06 249/213 |
| 4,899,978 | A | * | 2/1990 | Gates | E04G 17/0721 249/219.2 |
| 5,255,488 | A | * | 10/1993 | Johnson | E04G 17/0754 249/216 |

* cited by examiner

CONCRETE FORM CONSTRUCTION APPARATUS AND SYSTEM

CROSS-REFERENCE TO RELATED APPLICATIONS

This application is a continuation-in-part of application Ser. No. 15/906,598 filed Feb. 27, 2018.

FIELD OF THE INVENTION

The invention generally relates to the installation of concrete forms for creating walls, columns, and other non-horizontal concrete structures. In particular, the invention relates to an apparatus for positioning and locking concrete forms for receipt of concrete, thereby maintaining a desired distance and geometric shape and preventing the forms from separating and distorting the shape during the filling operation and simplifying the removal and preventing the loss of the apparatus after removal from the concrete forms.

BACKGROUND

The current methods for preparing concrete forms for construction projects are manpower-intensive, material-intensive, do not properly maintain the desired spacing easily, are costly, and inefficient. One common method for pouring a concrete wall requires two forms to be placed parallel with a desired wall thickness represented by distance between the forms. In the United States, the thickness of concrete is usually specified in inches, and common thicknesses are from 4-12 inches. The form builders then insert a multitude of heavy threaded rods into holes in the forms at various locations. The threaded rods extend through each of the concrete forms. Form builders then place a multitude large washers and nuts on protruding threaded rods. The nuts are tightened using a wrench to create the desired spacing width between the two forms. The form builders then cut blocks to the desired thickness and place them inside the cavity to maintain this thickness of the cavity between the forms and to prevent them distorting to less than the desired spacing.

After pouring and curing of the concrete, the form builders disassemble the concrete forms. During this deconstruction process, the nuts and washers are often lost since they are separate loose components and require replacement. Additionally, the threaded rods may be damaged during removal or may have to be cut off and left in place. Problems removing the threaded rods is to be expected since the threads inherently bond with the poured concrete and resist motion required to remove them after the concrete has hardened.

Adjacent forms are clamped together with multi-piece clamps that are assembled to grip adjoining portions of forms after the forms are brought into close proximity. These multi-piece clamps present an analogous problem to the problems of the threaded rods discussed above. Upon removing the clamps after the concrete is poured, pieces are often lost requiring replacement.

The current method for constructing and deconstructing concrete forms using threaded rod, nuts, washers, wrenches, spacer blocks, and multi-piece clamps have significant disadvantages that are manpower intensive, time intensive, equipment intensive, costly, wasteful, and ultimately inefficient.

SUMMARY OF THE INVENTION

The present invention overcomes these shortcomings by providing an apparatus that allows one skilled in the art, such as a form builder, to quickly construct and disassemble concrete forms with equipment that is relatively large and not easily lost at the construction site. The apparatus also prevents the concrete forms from moving inwardly or outwardly thus maintaining a consistent thickness of the concrete. Further, the assemblies maintain the desired geometric shape of the form. Additionally, the apparatus does not require tools for assembly or disassembly of the concrete forms. The apparatus may include an elongated locking pin, a retainer, and a form connector.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DESCRIPTION OF THE DRAWINGS

FIG. 6 is a side view a concrete form 500 with a pair of connecters 300 and retainers 200 attached.

FIG. 9 is a top view of a retainer 200 cooperating with an L-connecter 800 affixed to a concrete form 500 of the type having a strap inner rail 902 defining strap inner rail holes 904 therein.

DETAILED DESCRIPTION OF THE INVENTION

Figure 1:
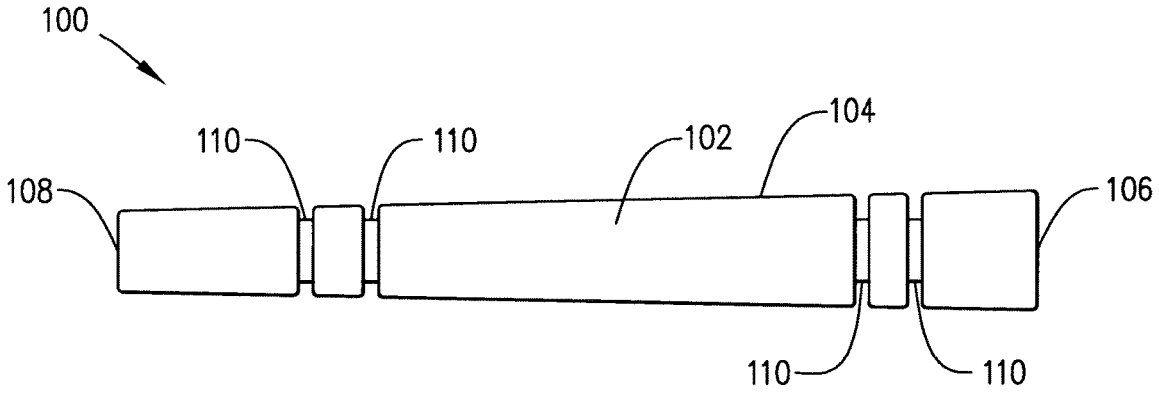
FIG. 1 is a side view of a locking pin 100.
Figure 7:
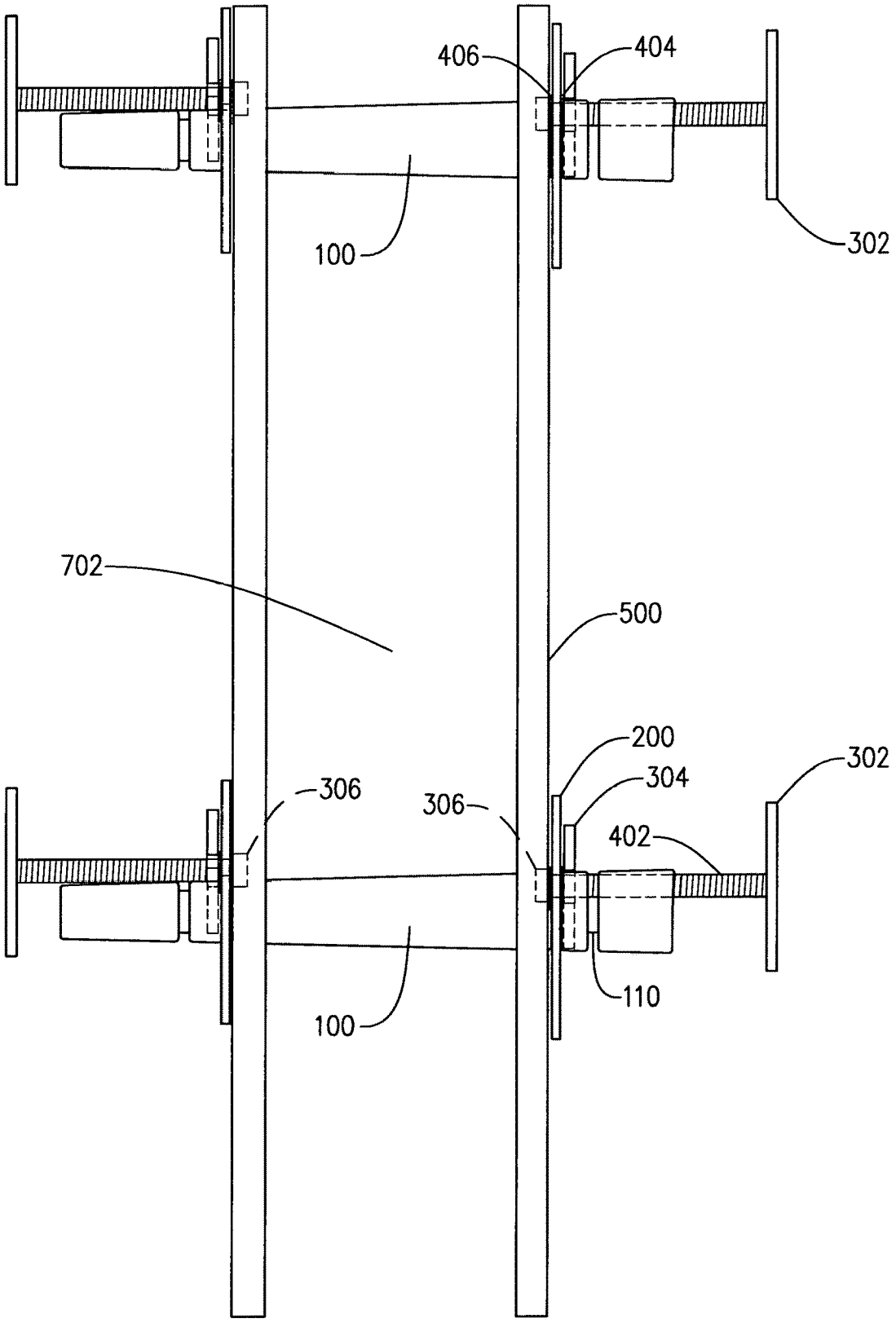
FIG. 7 is a top view of a pair of concrete forms 500 with a pair of locking pins 100 passing therethrough, each locking pin 100 engaged with a pair of connecters 300 cooperating with a corresponding pair of retainers 200 and maintaining a desired distance between the forms 500.

FIG. 1 is a side view of a locking pin 100. The locking pin 100 may comprise an elongated body 102 (here cylindrical, but other shapes would work) preferably with a tapered surface 104 having a larger end 106 and a smaller end 108 defining a plurality of locking slots 110 therein at each end. The tapered surface 104 allows a user to place the locking pin 100 through one side of a first concrete form 500, with the smaller end 108 exiting the first concrete form 500 and entering a second concrete form 500 and protruding from the second concrete form 500. The larger end 106 and smaller end 108 both protrude from the adjacent concrete forms 500 allowing access to at least one locking slot 110 on the outside of each form 500. FIG. 7 illustrates the relationship of the pin 100 with the two forms 500.

As the smaller end 108 of the locking pin 100 is placed inside a pin hole 510 defined through the concrete form 500, it will easily penetrate pin holes 510 through both concrete forms 500, but the diameter of the larger end 106 prevents the locking pin 100 from passing all the way through the pin hole 510 of the first concrete form 500. This tapered surface 104 from the larger end 106 to the smaller end 108 allows the user to easily place the concrete form locking pin 100 into the forms for set up and facilitates easier removal the locking pin 100 after the concrete has dried, bonding to the pin's surface to some extent. The surface 104 of the locking pin 100 may be coated with a release agent that allows the locking pin 100 to be more easily removed after the concrete pour. Also, a user may alternate the locking pins 100 entering from the different sides of the concrete forms 500 so that once they are locked in position, the tapered shape will also help prevent blowouts due to the concrete pressure.

Each locking pin 100 preferably defines several locking slots 110 near both the larger 106 and the smaller ends 108. These locking slots 110 slidingly engage a channel 204 defined in a head 202 of the retainer 200. See FIG. 2. The spacing of the locking slots 110 allow the user to create different form widths for pouring various thicknesses of concrete walls using the same pins.

Figure 2:
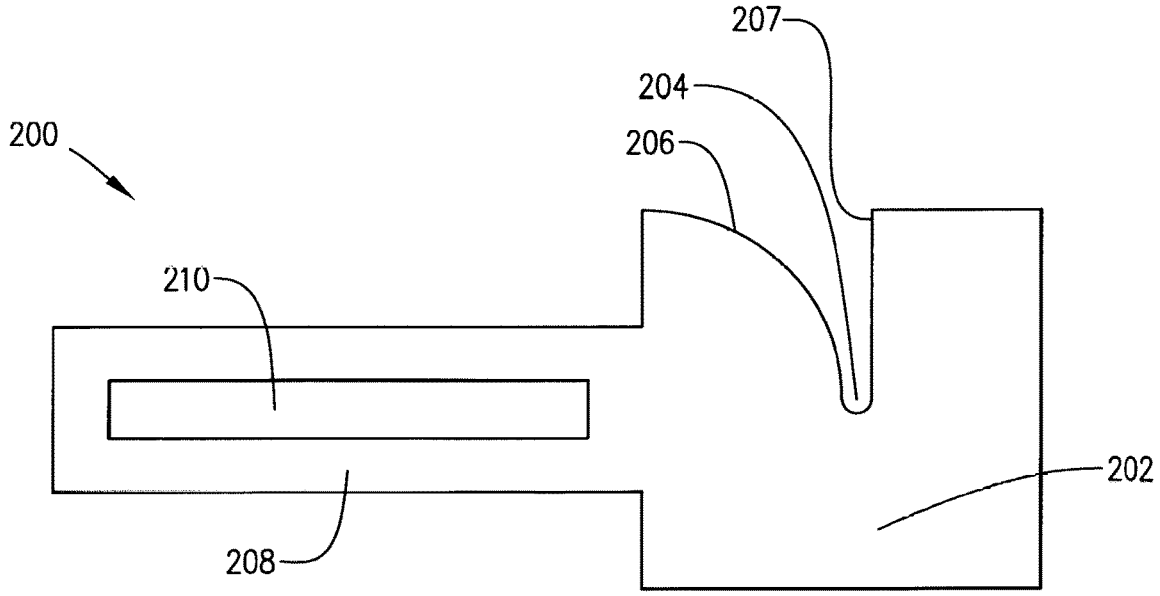
FIG. 2 is a side view of a retainer 200.

FIG. 2 is a side view of a retainer 200. The retainer 200 may comprise a head 202 defining therein a channel 204 with a curved edge 206 and a straight edge 207, and an arm 208 defining an adjustment slot 210 therein extending for much the length of the arm 208. The locking pin 100 is placed through a pin hole 510 in a concrete form 500 that will be described in greater detail in FIG. 5. The retainer 200 is placed perpendicular to the locking pin 100 such that the channel 204 engages a locking slot 110 preventing the locking pin 100 from being pulled through the concrete form 500. Additionally, the other portion of the retainer 200, the arm 208 and slot 210 provide a surface for the application of torque by a connecter 300 described below to more firmly engage the retainer 200 with the form 500. Once the connector 300 is firmly engaged with the form 500, it prevents the forms from collapsing toward each other or expanding outward until concrete is poured into the space defined between them.

The retainer 200 may be rotated about the connecter 300 to engage the locking slots 110. The preferred method of engaging the locking slots 100 is to engage them from the top with the retainer 200, so that if movement was to occur and loosen the connecter 300, the retainer 200 would remain in place by the force of gravity preventing release of the concrete form 500. The curved edge 206 allows the user to rotatingly engage and disengage a locking slot 110 while the connecter 300 is affixed to the concrete form 500. Without the curved edge 206, the channel 204 would not be able to rotatingly engage a locking slot 110 while the retainer 200 is affixed to a form 500 by the connecter 300. Without the curved edge 206 a user would have to simultaneously engage the concrete form 500, the locking pin 100, the retainer 200 and the connector 300, making the assembly of the forms difficult.

Figure 3:
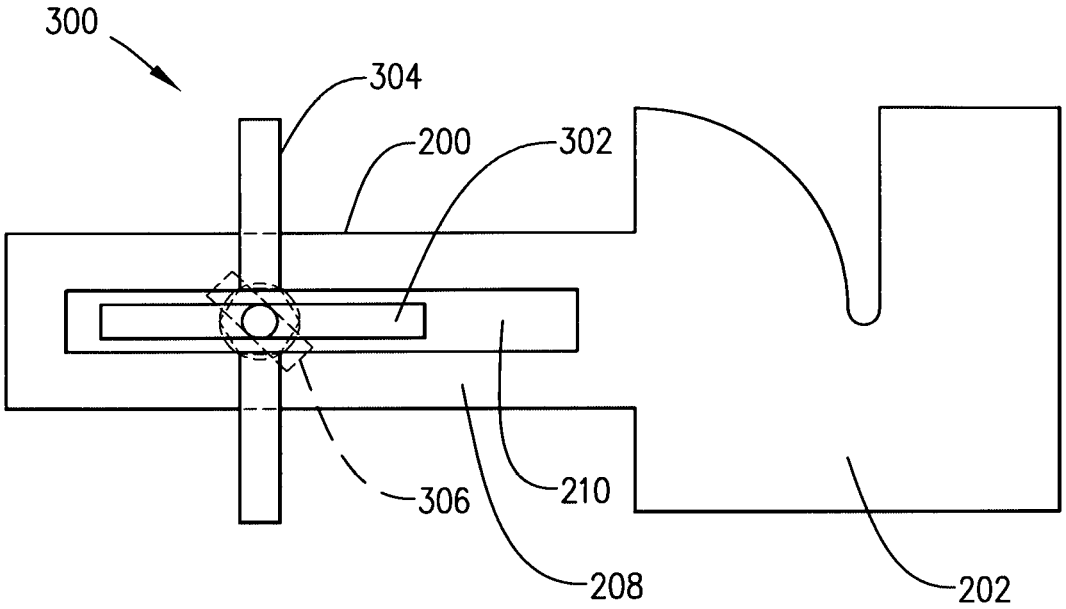
FIG. 3 is a side view of a connecter 300 engaging the retainer 200.

FIG. 3 is a side view of a connecter 300 attached to the retainer 200. The connecter 300 preferably comprises a connector handle 302 affixed at one end of a threaded rod 402. The threaded rod 402 preferably has coarse threads 403 which are appropriate given the abrasive nature of concrete and the construction environment. Affixed to the other end of the threaded rod 402 is a means for engaging the connecter 300 with a form rail 502, 504 or 902. The means for engaging is preferably a tubular member affixed perpendicular to the threaded rod 402 at the second end thereof. The tubular member may be affixed to the threaded rod 402 in the middle of the tubular member, in which case it is called a T-connector 306. See FIG. 4. Alternatively, the tubular member may be affixed to the threaded rod 402 at a terminal end of the tubular member, in which case it will be referred to as an L-connecter 802. See FIG. 8. A tightener 304 defines threads in a hole defined therethrough which are threadedly engaged with the threaded rod 402. The tightener 304 is disposed between the connecter handle 302 at a first end and either the L-connector 802 or the T-connecter 306 at a second end. The T-connecter 306 or L-connecter 802 is a head piece rigidly affixed to an end of the threaded rod 402. The T-connecter 306 extends outward in both directions from the threaded rod 402 creating a "T" shape while the L-connector 802 extends outwardly from the threaded rod 402 in only one direction. In the preferred embodiment, the tightener 304 comprises threaded nut to threadedly engaging the threaded rod 402 with handles extending outwardly from opposite sides of the threaded nut. The extensions are of sufficient length to allow a user to provide torque to maintain the connecter 300 in place. These extensions allow the user to rotate the tightener 304 about the threaded rod 402 to move it along the threaded rod 402 to tighten or loosen the grip the tightener 304 and either the T- or L-connector exert on the inner rail 504. The T-connector 306 is preferably used with forms 504 having inner rails 504 defining inner rail slots 508 therein. The L-connector 802 is preferably used with strap inner rails 902 defining strap inner rail holes 904 therein. Preferably, an engagement washer 404 and a retaining washer 406 are disposed on opposite sides of the tightener 304 and slidingly engage the threaded rod 402.

The T-connector 306 allows a user to place the connecter 300 in engagement with the retainer 200 through the adjustment slot 210 and also engage a concrete form 500. The T-connector 306 is placed through an inner rail slot 508 of the concrete form 500. The user may rotate the connecter handle 302 causing the T-connecter 306 to rotate and engage slot 508. This engagement prevents the connecter 300 from disengaging from the concrete form 500. A user may then hold the connector handle 302 and rotate the tightener 304 to engage the retainer 200 and to secure it in place against the concrete form.

Figure 4:
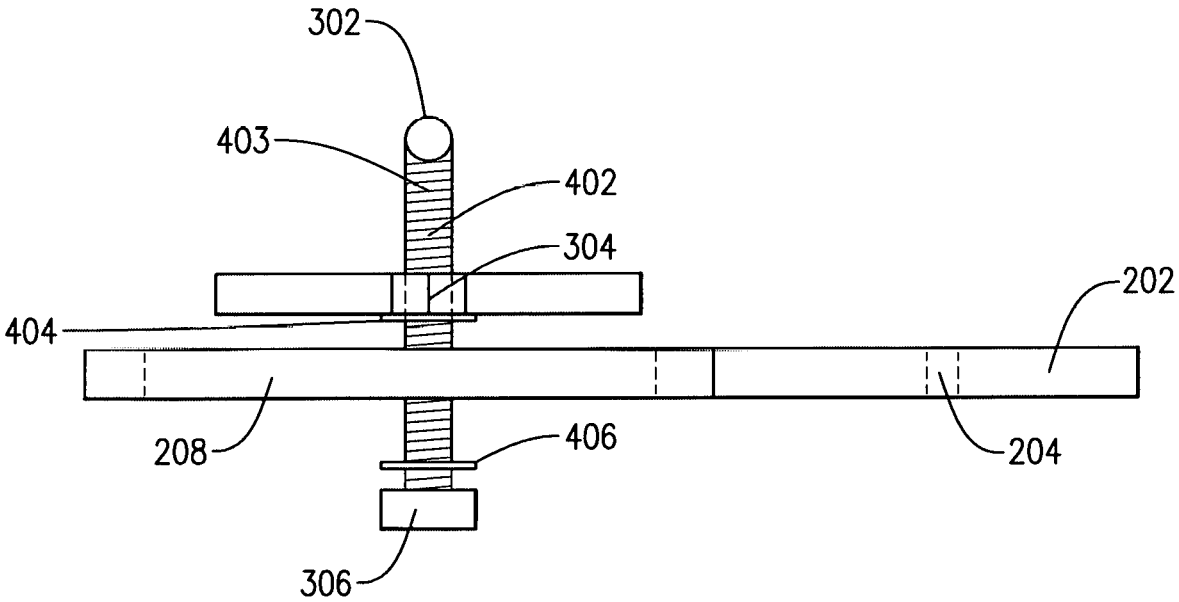
FIG. 4 is top view of the connecter 300 engaging the retainer 200.
Figure 3:
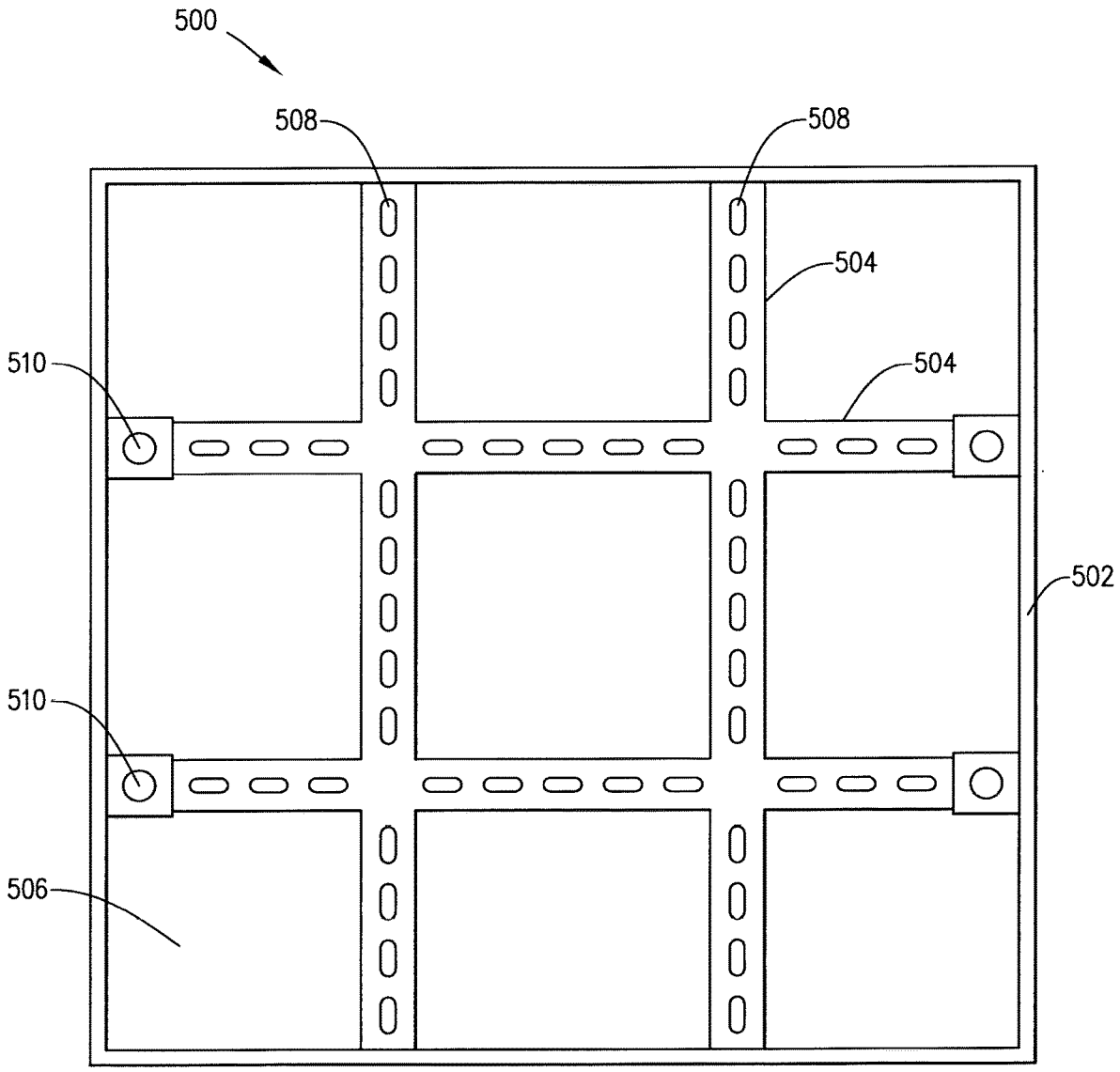

FIG. 4 is a top view of the connecter 300 engaged with the retainer 200. As noted, the connecter 300 may comprise a threaded rod 402, an engagement washer 404 and a retaining washer, 406. In this preferred embodiment, connecter 300 engages the retainer 200 such that the retaining washer 406 prevents the connecter 300 from becoming detached from the retainer 200, thereby making the combination of the retainer 200 and the connecter 300 a single unit. This configuration is preferred because it minimizes loss of separate loose parts. Additionally, an engagement washer 404 allows a user to rotate the tightener 304 disposed within the adjustment slot 210 of the retainer 200, thereby securing the connecter 300 and retainer 200 in place and engaged not only with the concrete form 500, but also engaging and preventing the locking pin 100 from moving. The washers are preferably placed before the T- or L-connector is fixedly attached to the threaded rod, and the inner and outer diameter of the two washers prevent the threaded rod 402 and its attached components from disengaging from the retainer 200.

Incorporated by reference is quick release clamp (U.S. Pat. No. 6,712,376 Eberhardt et al.) (the "'376 Patent") that may replace the tightener 304 and the threaded rod 402. In addition to the threaded embodiment disclosed herein, it would be apparent to one skilled in the art to employ a quick release clamp to engage the retainer 200 and secure it to the form 500. See for example U.S. Pat. No. 6,260,921 for a "safe quick-release bicycle axle fastener" (hereinafter the "'921 Patent"). Applicant incorporates the '387 Patent and the '921 Patent by reference, particularly FIGS. 3, 4 and 8 and related sections of the '291 Patent specification disclosing the quick-release cam.

If it is desired to allow the retainer 200 to be separated from the connecter 300, the retaining washer 406 may be omitted from the construction. Additionally, the connector handle 302 may be removable to facilitate the removal of the retaining washer 406 thereby allowing a user to separate the connector 300 and retainer 200. The handle 302 may have mated thread to affix to the threaded rod 402. Other methods of attaching the handle 302 to the threaded rod 402 allowing a user to remove the handle 302 would be apparent to one skilled in the art.

Figure 5:
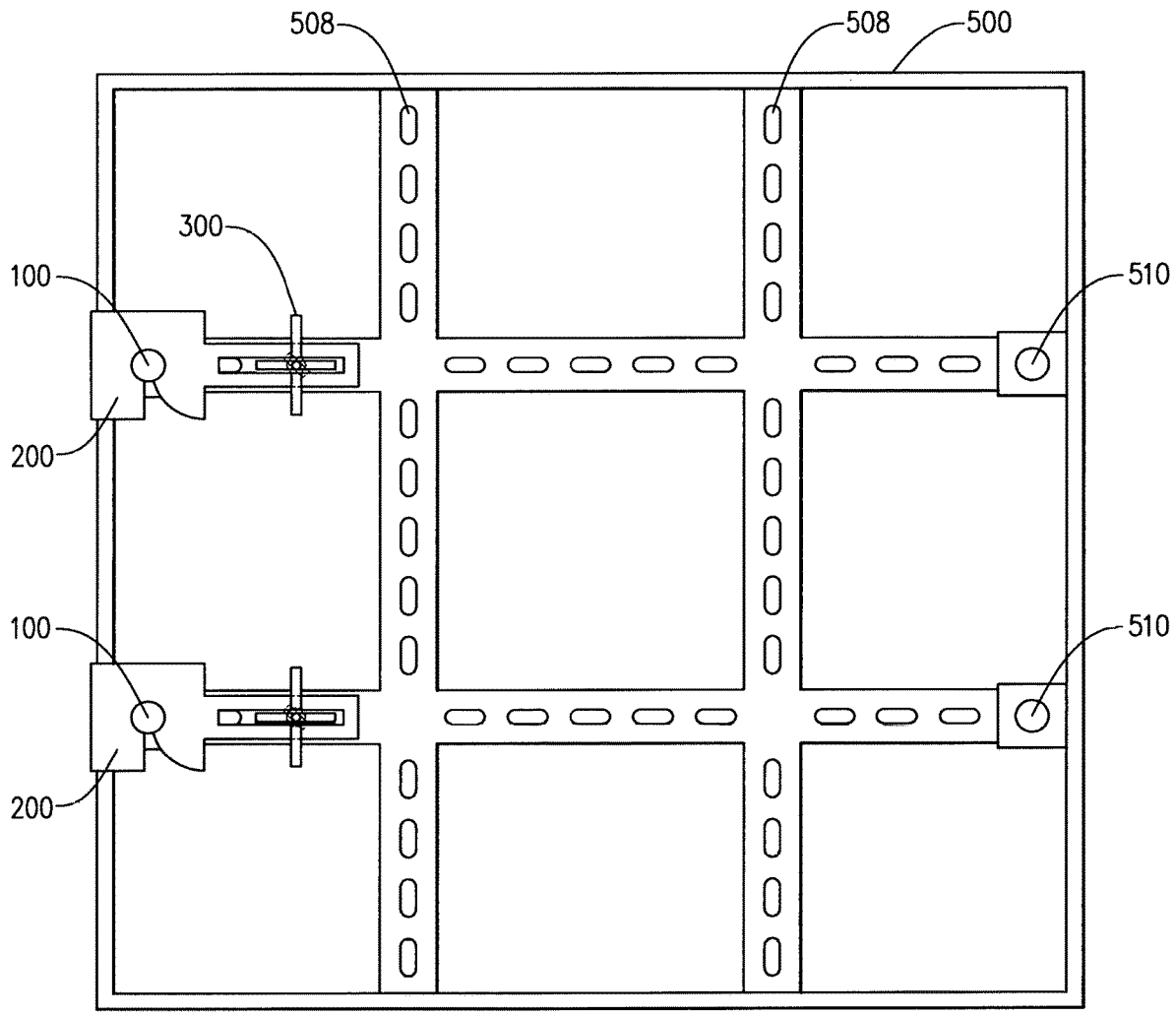
FIG. 5 is a side view of one embodiment of a concrete form 500.

FIG. 5 is a front view of a concrete form 500. Concrete forms usually are typically constructed with a rectangular (often square) metal frame and a wood or composite face sheet mounted thereon. The face sheet is in direct contact with the poured concrete. The main variation relevant here relates to whether the rails (inner and side) are comprised of rectangular tube or sheet metal. Where the rails are comprised of rectangular tube, there typically are holes defined therein that are usually oval-shaped. See FIG. 5 showing inner rail slots 508. Inner rail slots are preferably engaged by t-connectors 306. Where the rails are comprised of sheet metal, holes are drilled therethrough. See FIG. 9 showing strap inner rail holes 904. Strap inner rail holes 904 are preferably engaged by L-connectors 802.

The metal frame of the concrete form 500 comprises side rails 502 defining pin holes 510 therein or adjacent thereto, and inner rails 504 defining inner rail slots 508. A face sheet 506 is affixed to the steel frame. Multiple concrete forms 500 may be connected side-by-side such that they create an extended single form to create a continuous wall when concrete is poured into the space defined between opposing concrete forms 500. Inner rails 504 typically create a grid pattern throughout the concrete form 500 to provide rigidity of the concrete form 500 and to prevent concrete from blowing out through the face sheet 506. Defined in the inner rails 504 there may be defined a multitude of inner rail slots 508. Also, in the inner rails 504 or side rails 502, there may be defined a multitude of pin holes 510 allowing for various placement of the locking pins 100 depending on the desires of the user and the type of construction that is involved.

FIG. 6 is a front view of a concrete form 500 with locking pins 100 secured in place by retainers 200 that also engage the inner rail slots 508 via the connecters 300. This view shows two locking pins 100 placed through the pin holes 510 in the concrete forms 500. A user may preferably attach the retainer 200 to the concrete forms 500 by inserting the T-connecter 306 into the inner rail slots 508 then rotating the connecter handle 302 ninety degrees to fully engage shoulders of the inner rail slots 508. The user may then, while holding the form connector handle 302 in position or having lightly tightened the tightener 304, rotatably and slideably position the channel 204 to engage the locking pin 100 at the desired locking pin slot 110. Once the retainer 200 engages the locking pin 100, the locking pin 100 may no longer slide through the pin hole 510. Once the engagement has occurred, a user may then rotate the tightener 304 to secure the arm 202 to the concrete form 500 to prevent an undesired release. As noted, securing the arm 208 to the inner rail slot 508 also prevents opposing forms from collapsing in toward one another.

A user may release the concrete form 500 by rotating the tightener 304 in the opposite direction from above thereby releasing the retainer 200 allowing it to freely move. The user may disengage the retainer 200 from the locking pin 100 allowing the locking pin 100 to be removed. The locking pin 100, if it has the preferable tapered surface 104 must be forced out the same side as the larger end 106 protrudes from. Once the locking pins 100 are removed the concrete forms any also be removed leaving a finished concrete structure.

FIG. 7 is a top view of a pair of concrete forms 500 with locking pins 100 positioned and secured in place by retainers 200 using connecters 300. This view illustrates concrete forms 500 in a position ready to accept a concrete pour into the cavity 702 defined between opposing forms 500. In this preferred embodiment, there may be upper and lower locking pins 100 holding opposing forms in position. The locking pins 100 may be inserted into the first concrete form 500, then extended to and through the second and opposing concrete form 500. Retainers 200 and connecters 300 may be placed at the larger end 106 and the smaller end 108 of the locking pins 100. After the connecters 300 engage the concrete forms 500, the retainers 200 may then engage the locking pins 100 at the respective locking slots 110. The user may then tighten the tighteners 304 to secure the locking pins 100 in place to prevent them from moving. By tightening the tighteners 304, a semi-rigid to rigid structure is created, reducing the possibility of preventing a blowout caused by the pressure of the poured concrete.

As described earlier, a series of locking slots 110 may be created near each end 106, 108 of the locking pins 100. This series of locking slots 110 provides a user the ability to adjust the width of the cavity 702 created between opposing concrete forms 500 by selecting different locking slot 110 to achieve a desired distance. Additionally, a user may use different locking slots 110 to create a tapering effect in the thickness of the concrete slab in the horizontal direction and/or vertical direction.

Figure 8:
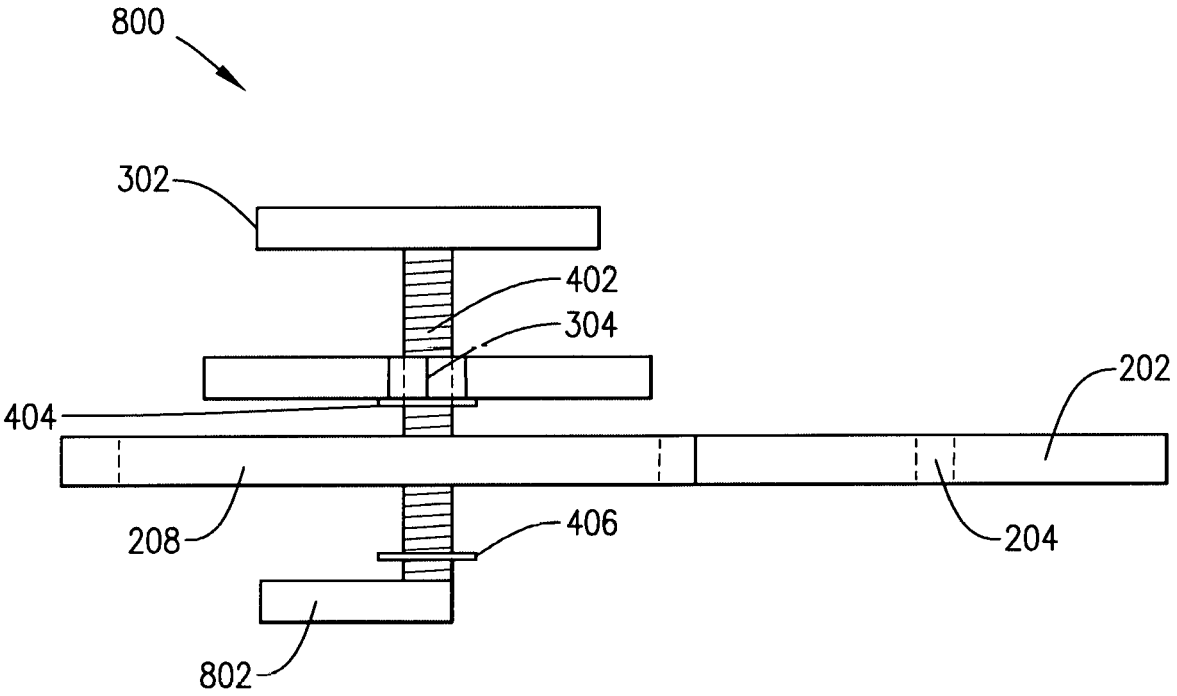
FIG. 8 is a top view of a connecter 300 engaged with an L-connecter 800.
Figure 3:
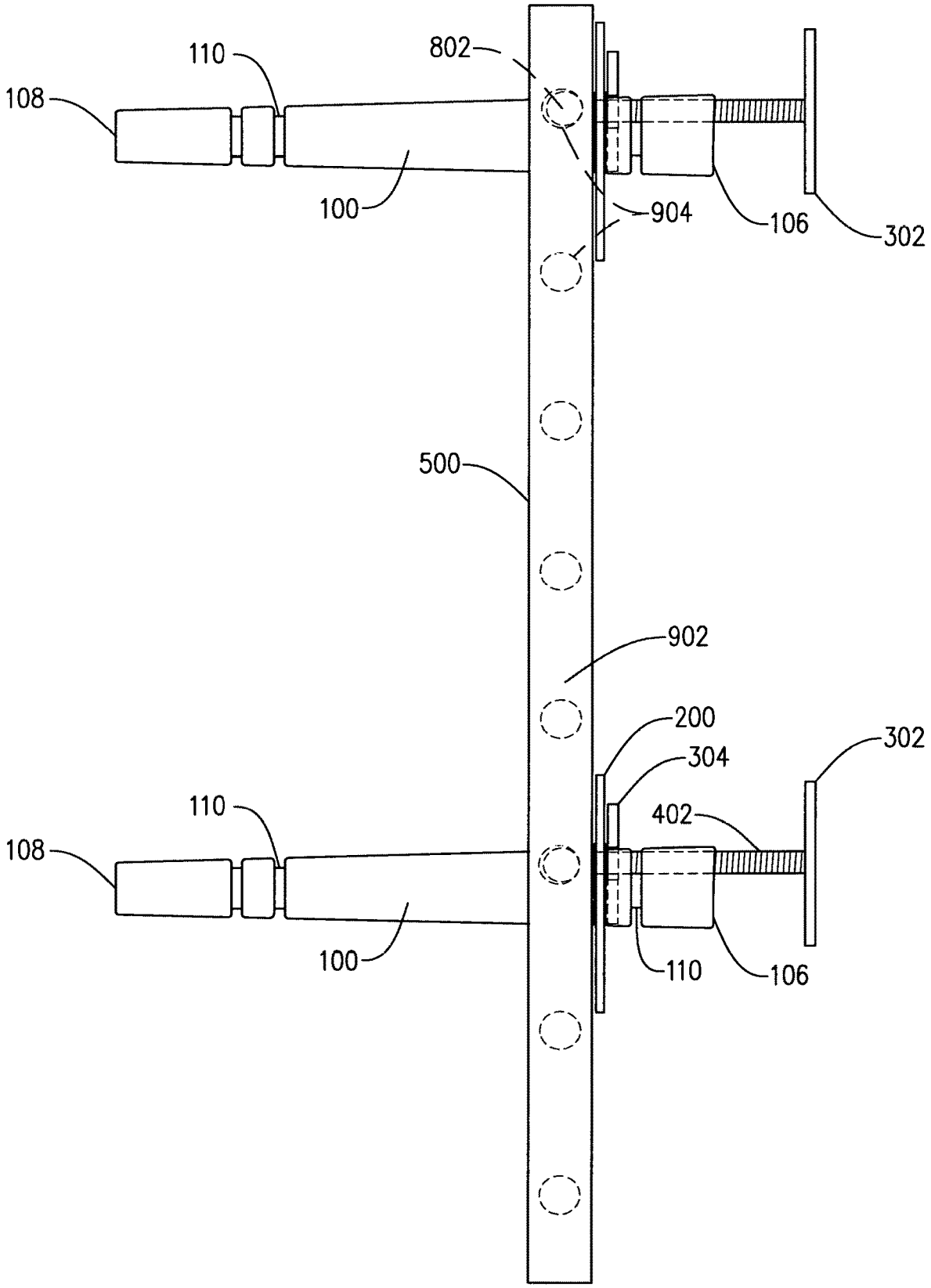

FIGS. 8 and 9 illustrate an L-connecter embodiment of the invention. FIG. 8 is a top view of the L-connecter embodiment with a retainer 200 used in conjunction with a modified connector 300 configured with an L-connecter 802. The L-connecter connector is a variation from the T-connecter 306 shown in FIG. 4. FIG. 9 illustrates how the L-connecter 802 is better adapted to engage strap inner rail holes 904, which are a variation from the inner rail slots 508 present in forms for which the T-connecter 306 is used. FIG. 9 illustrates the L-connecter 800 engaging the strap inner rail holes 904 securing the retainer 200 and locking pin 100 in place.

Figure 10:
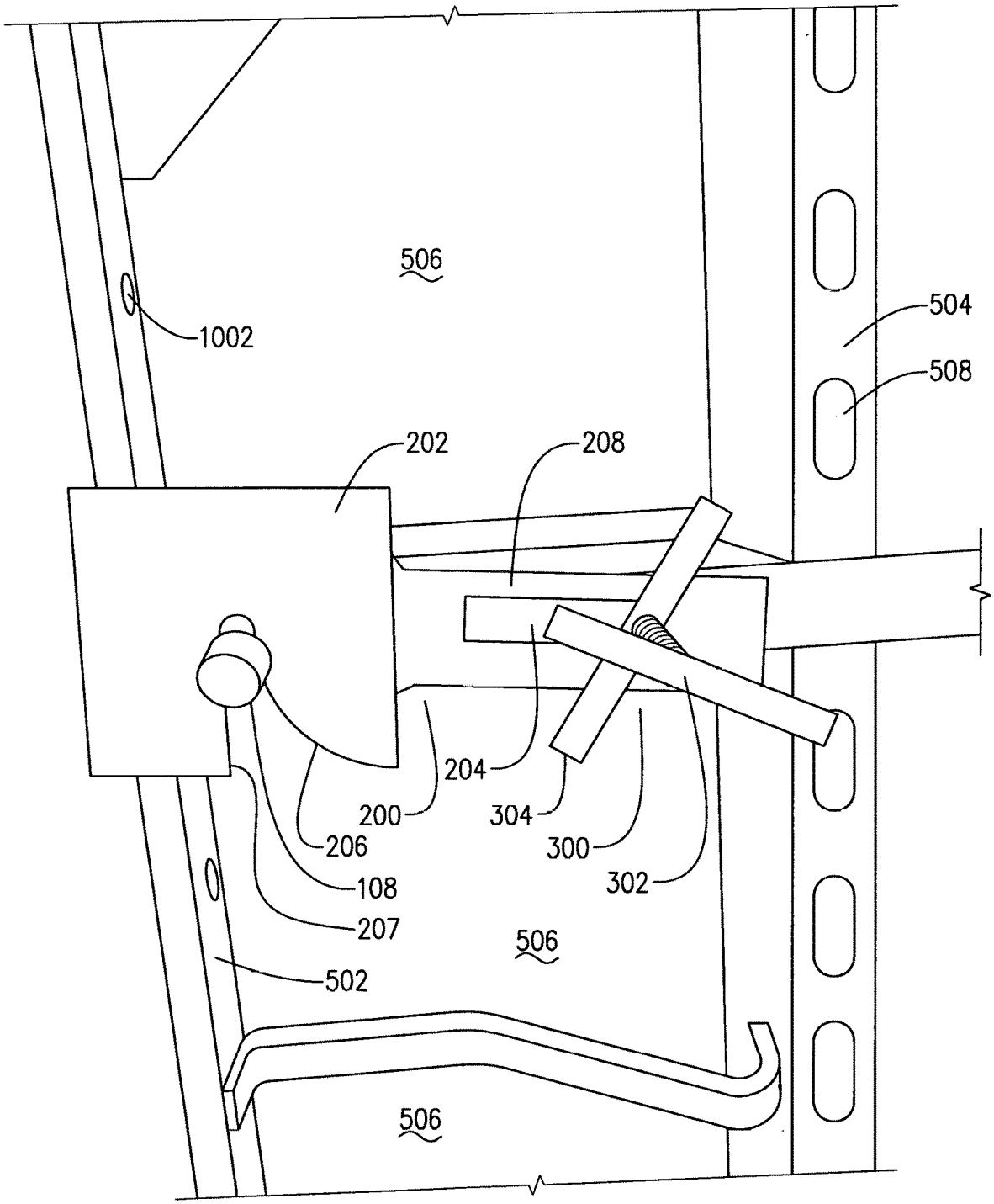
FIG. 10 is a picture of a side view of a form 500 with the head 202 of a retainer 200 engaging a locking pin 100 at the smaller end 108 thereof while a connector 300 is passing through the channel 204 to engage an inner rail slot 508 (not visible).

FIG. 10 is a perspective view of a retainer 200 and a connector 300 engaged with a form 500 having inner rails 504 constructed of rectangular tube and side rails 502 comprised of strap metal defining side rail holes 1002 therein. A form 500 can be seen with the head 202 of a retainer 200 engaging a locking pin 100 at the smaller end 108 thereof while a connector 300 is passing through the channel 210 to engage an inner rail slot 508 (not visible in Fig.).

Figure 11:
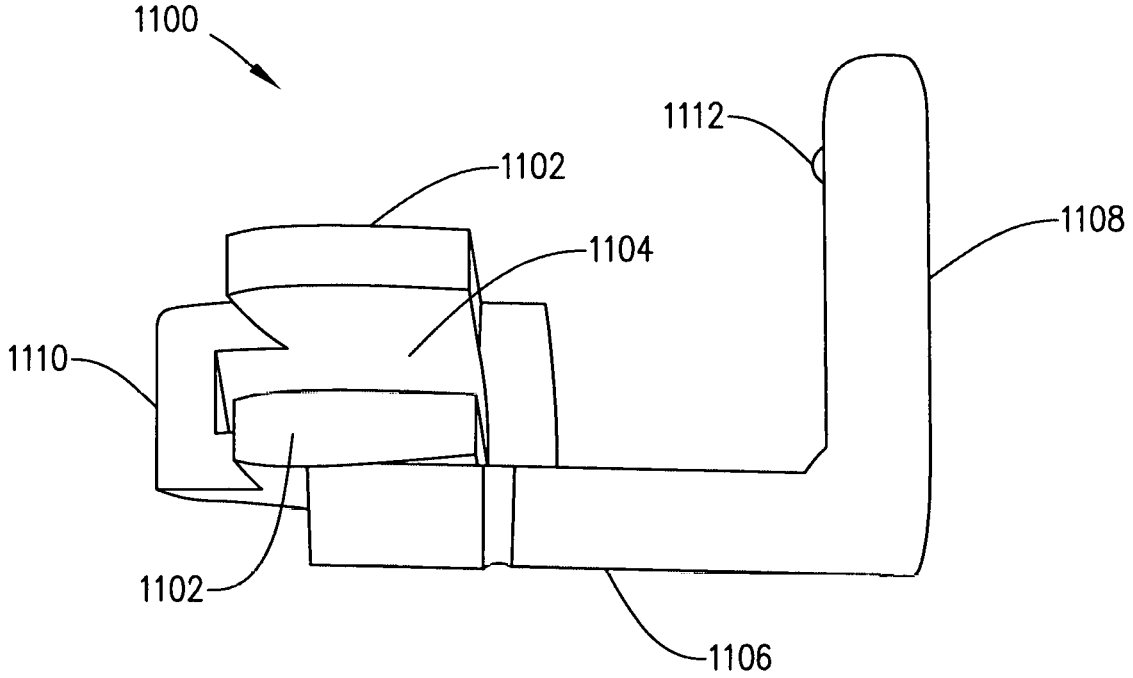
FIG. 11 is a bottom view of clamp 1100 having pair of jaws 1102 defining a channel 1104 therebetween and a clamp arm 1106 projecting out to a clamp pin 1108 perpendicular thereto.

FIGS. 11-14 illustrate a clamp 1100 adapted to hold adjacent forms 500 in close proximity. FIG. 11 shows a bottom view of the clamp 1100 having pair of jaws 1102 projecting outwardly from a clamp cap 1110 and defining a channel 1104 therebetween. The clamp 1100 has a clamp arm 1106 projecting outwardly from the cap 1110 with a clamp pin 1108 mounted at a terminal end of the clamp arm 1106 and perpendicular thereto. Near a terminal end of the clamp pin 1108 there is preferably a retainer ball 1112 which is spring-loaded to assist in retaining the pin 1108 within the strap inner rail hole 1002.

Figure 12:
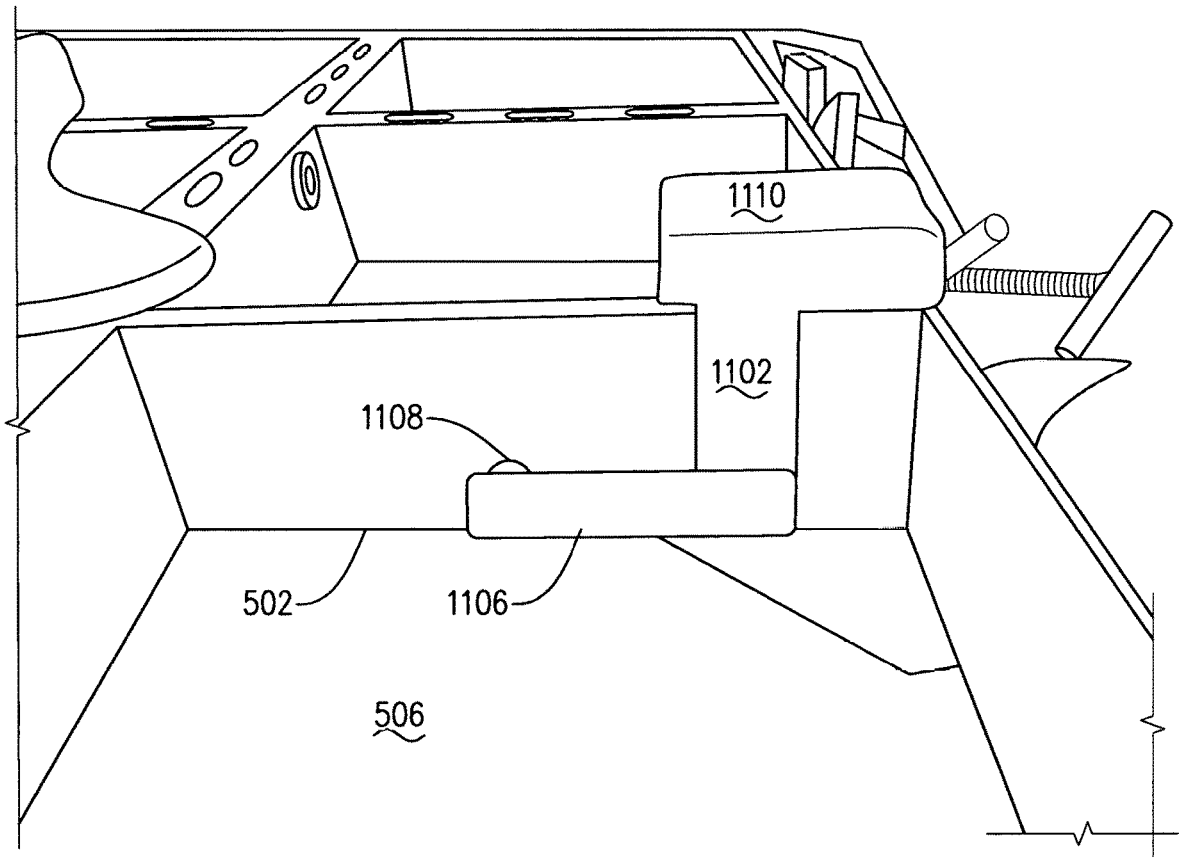
FIG. 12 is a perspective view of a clamp 1100 connecting two adjacent form side rails 502 together with the clamp pin 1108 passing through side rail holes 1002 in adjoining forms 500.
Figure 13:
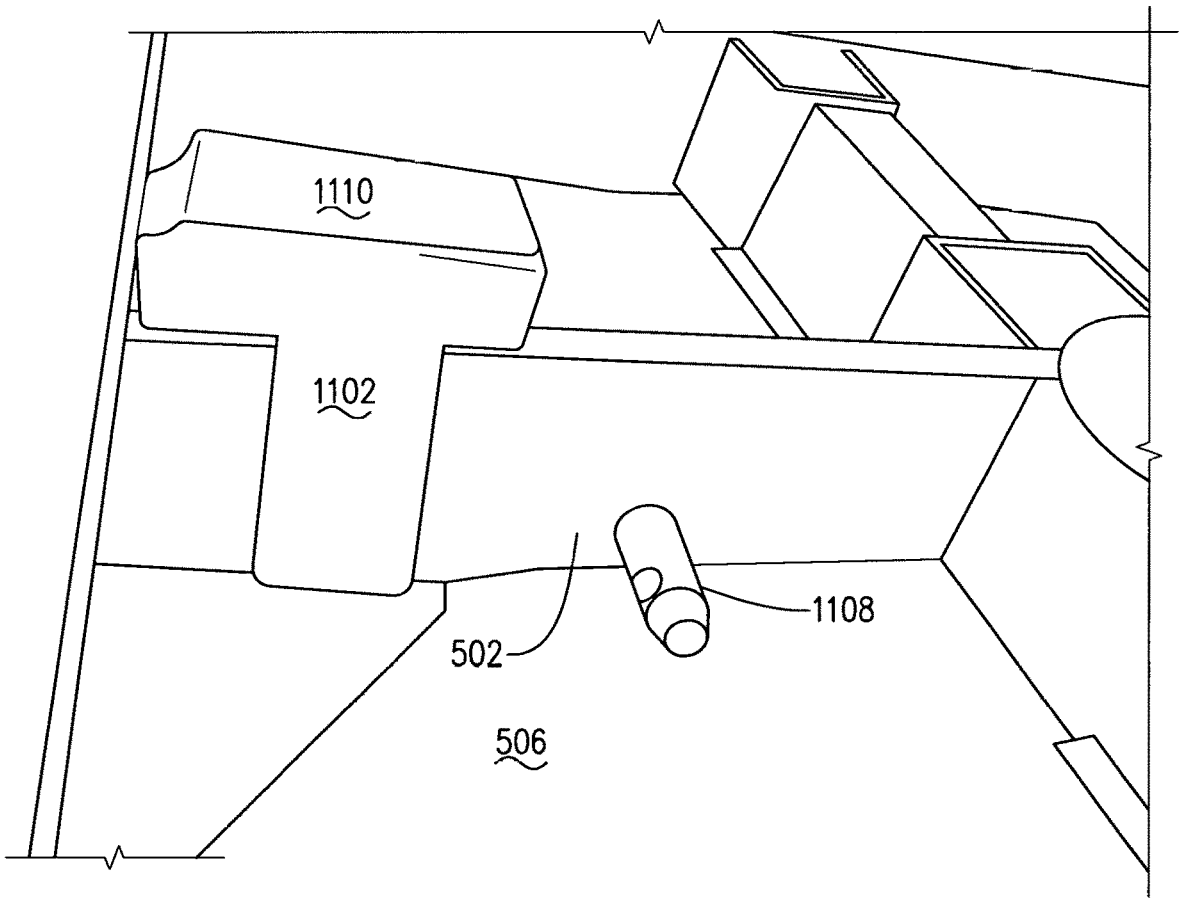
FIG. 13 is the opposite perspective view of the one shown in FIG. 12 more clearly showing the clamp pin 1108.
Figure 14:
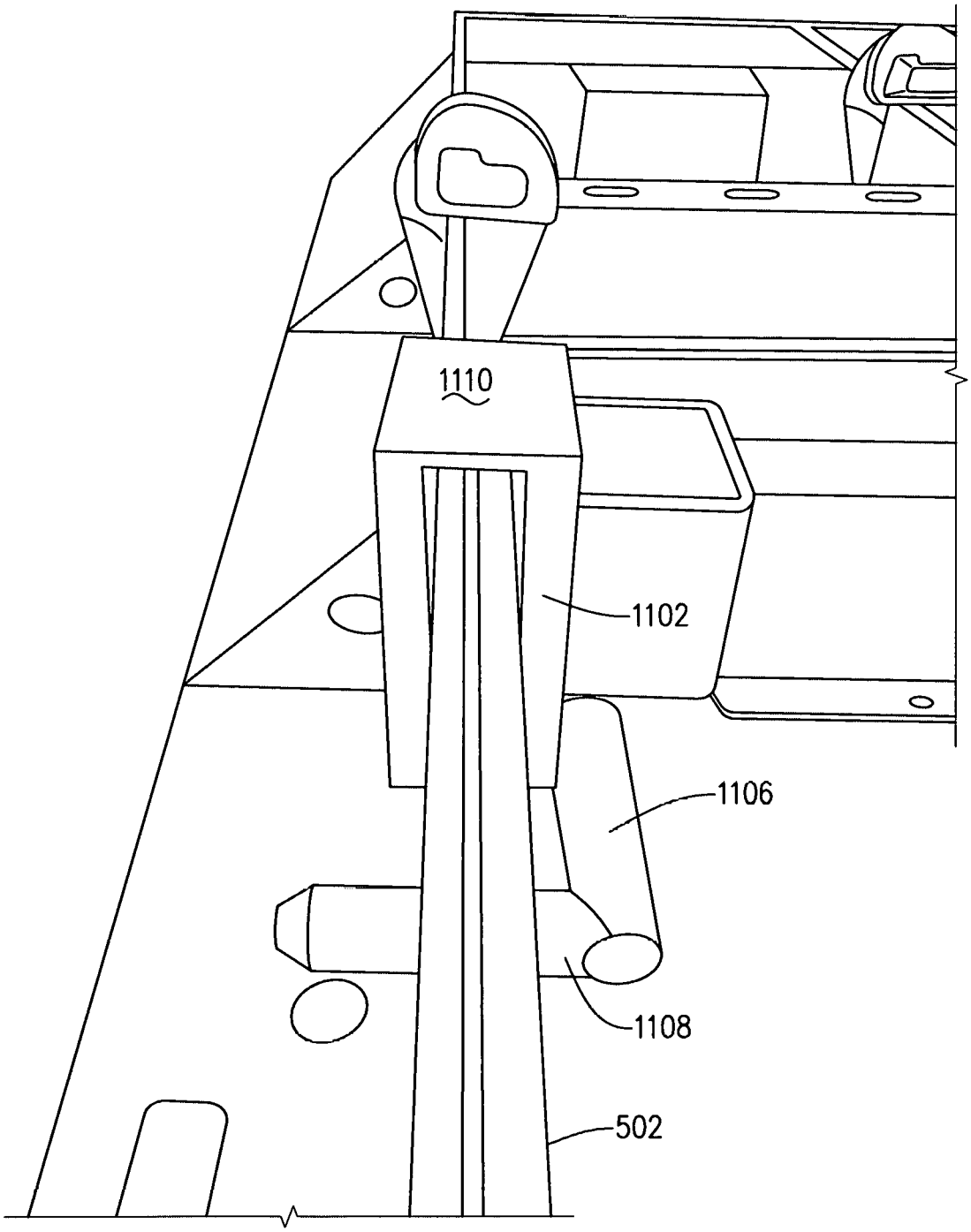
FIG. 14 is a rotated perspective view (relative to FIGS. 13 and 14) of a clamp 1100 engaging adjacent side rails 502.

FIG. 12 is a perspective view of the clamp 1100 connecting two adjacent form side rails 504 together with the clamp pin 1108 passing through side rail holes 1002 in adjoining forms 500. FIG. 13 is the opposite perspective view of the one shown in FIG. 2 more clearly showing the clamp pin 1108 with the retainer ball 1112. FIG. 14 is a rotated perspective view (relative to FIGS. 13 and 14) of a clamp 1100 engaging adjacent side rails 502. A prior art clamp is shown above the clamp 1100 of the present invention. The prior art clamp is comprised of three separate pieces and is assembled on-site once the adjacent forms are brought into close proximity.

Having thus described the invention, I claim:

1. An apparatus for connecting at least one pair of concrete forms disposed at a desired distance from each other, defining a space there between to receive concrete to be poured, the forms defining a plurality of first holes therein shaped and sized to receive circular members holding the forms apart at the desired distance and also defining a plurality of second holes, the apparatus comprising:

a) at least one locking pin having a first end defining therein at least one locking slot, a second end defining therein at least one locking slot, the locking pin sized to pass through first holes in opposing forms;

b) at least one retainer for each locking pin, the retainer having— i) a head defining a channel therein sized to slidingly engage the locking slots the channel further having one straight edge and one curved edge, and ii) an arm projecting out from the head and defining an elongated adjustment slot therein; and c) a connecter having— i) a threaded rod with a handle at a first end and a connecter handle at a second end removably inserted into one of the second holes in the form, the threaded rod disposed within the arm's slot, and ii) a tightener defining a female threaded member threadedly engaging the threaded rod and further defining at least one handle projecting outwardly from the female threaded member, the tightener threadedly pressing against the form to hold the arm firmly against the form;

whereby the locking pin is passed through a pair of first holes in opposing forms, and the at least one retainer is engaged with a locking slot on an outside of at least one form and secured to the form using the connecter engaging one of the second holes.

2. The apparatus of claim 1 where each locking pin has a tapered surface with a smaller first end a larger second end, the larger second end being too large to pass through the first holes.

3. The apparatus of claim 1, where each end of each locking pin defines multiple locking slots therein allowing for different desired distances between the forms to be set using the same apparatus.

4. The apparatus of claim 1, where each locking pin is alternated entering the form is disposed from opposing sides.

5. An integrated apparatus for connecting at least one pair of concrete forms is disposed at a desired distance from each other defining a space there between to receive concrete to be poured, the forms defining a plurality of first holes therein shaped and sized to receive circular members holding the forms apart at the desired distance and also defining a plurality of second holes, the apparatus comprising:

a) a plurality of locking pins having a larger first end too large to pass through the first holes, the first end defining therein at least two locking slots, a smaller second end defining therein at least two locking slots, the tapered surface of the locking pin sized to pass through first holes in opposing forms;

b) two retainers for each locking pin and disposed outside of opposing forms, each retainer having— i) a head defining a channel therein sized to slidingly engage the locking slots the channel further having one straight edge and one curved edge, and ii) an arm projecting out from the head and defining an elongated adjustment slot therein; and c) a connecter having— i) a threaded rod with a handle at a first end and a connecter handle at a second end removably inserted into one of the second holes in the form, the threaded rod non-removably disposed within the arm's slot, and ii) a tightener defining a female threaded member threadedly engaging the threaded rod and further defining at least one handle projecting outwardly from the female threaded member, the tightener threadedly pressing against the form to hold the arm firmly against the form;

whereby the plurality of locking pins are passed through multiple pairs of first holes in opposing forms, and for each locking pin a retainer is engaged with a locking slot on an outside of both opposing forms and secured to the form using the connecter engaging a respective one of the second holes.

6. A system for constructing concrete forms of the type in which at least one pair of concrete forms is disposed at a desired distance from each other defining a space there between to receive concrete to be poured, the forms defining a plurality of first holes therein shaped and sized to receive circular members holding the forms apart at the desired distance and also defining a plurality of second holes, the forms each also having a plurality of rails around their periphery and crisscrossing their interior, the type of forms also having angle members providing the ability for the system to make 90-degree turns, the system comprising:

a) an apparatus for connecting opposing concrete forms having— i) at least one locking pin having a first end defining therein at least one locking slot, a second end defining therein at least one locking slot, each pin sized to pass through first holes in opposing forms;

ii) at least one retainer for each locking pin, each retainer having— a) a head defining a channel therein sized to slidingly engage the locking slots, the channel further having one straight edge and one curved edge, and b) an arm projecting out from the head and defining an elongated adjustment slot therein; and iii) a connecter having— a) a threaded rod with a handle at a first end and a connecter handle at a second end removably inserted into one of the second holes in the form, the threaded rod disposed within the arm's slot, and b) a tightener defining a female threaded member threadedly engaging the threaded rod and further defining at least one handle projecting outwardly from the female threaded member, the tightener threadedly pressing against the form to hold the arm firmly against the form; and b) a clamp for releasably joining adjacent forms, the clamp having— i) a pair of jaws defining a space there between sized to receive two side rails, ii) an arm extending out from the jaws, the arm connected at its terminal end to a pin adapted to engage cooperating holes defined in adjacent side rails;

whereby each locking pin is passed through multiple pairs of first holes in opposing forms and a retainer is engaged with a locking slot on an outside of at least one form and secured to the form using a connecter engaging one of the second holes, and at least one clamp engages adjacent side rails to hold adjacent forms in proximity.

* * * * *